US005137180A

United States Patent [19]

Kieras

[11] Patent Number: 5,137,180

[45] Date of Patent: Aug. 11, 1992

[54] VENTED AEROSOL DEVICE

[75] Inventor: Ronald E. Kieras, Cary, Ill.

[73] Assignee: Pittway Corporation, Cary, Ill.

[21] Appl. No.: 578,189

[22] Filed: Sep. 6, 1990

[51] Int. Cl.[5] ..... B65D 83/14

[52] U.S. Cl. ..... 222/108; 222/148; 222/402.13; 222/402.21; 239/337; 239/573

[58] Field of Search ..... 222/108, 148, 402.1, 222/402.12, 402.13, 402.23, 571; 239/112, 337, 573

[56] References Cited

U.S. PATENT DOCUMENTS

| | | | |
|---|---|---|---|
| 3,107,826 | 10/1963 | Kruck | 222/402.13 |
| 3,223,332 | 12/1965 | Nyden | 222/402.13 X |
| 3,260,416 | 7/1966 | Abplanalp | 222/402.13 |
| 3,377,005 | 4/1968 | Marder | 222/402.13 |
| 3,578,220 | 5/1971 | Green et al. | 222/402.23 X |
| 3,692,215 | 9/1972 | Nigro | 222/402.13 |
| 3,785,528 | 1/1974 | Mandeltort | 222/402.13 X |
| 4,219,135 | 8/1980 | Ufferfilge | 222/402.23 X |
| 4,437,592 | 3/1984 | Bon | 222/402.23 X |
| 4,636,102 | 1/1987 | Drake | 222/402.13 |
| 4,901,891 | 2/1990 | Goncalves | 222/402.13 |
| 4,941,600 | 7/1990 | Berriochoa et al. | 222/402.14 X |
| 4,978,035 | 12/1990 | Morane et al. | 222/108 |

*Primary Examiner*—Kevin P. Shaver
*Attorney, Agent, or Firm*—Frijouf, Rust & Pyle

[57] ABSTRACT

An apparatus for an improved aerosol spraying device comprising an aerosol valve being moveable between an open and a closed position for releasing a product from the aerosol container. The aerosol valve is resiliently biased into the closed position. A valve button having a terminal orifice is movable between a first and a second position with the valve button being biased into the first position. The valve button opens the aerosol valve when the valve button is moved into the second position and allows the aerosol valve to close when the valve button is in the first position. A vent cooperating with the valve button and the aerosol valve is closed when the valve button is moved into the second position to direct the product release from the aerosol valve to the terminal orifice. The vent is opened upon movement of the valve button from the second position to the first position for directing the product released from the aerosol valve during the closing of the aerosol valve to the vent to prevent dribbling of the product from the terminal orifice.

1 Claim, 6 Drawing Sheets

VENTED AEROSOL DEVICE

BACKGROUND OF THE INVENTION

1. Field of the Invention

This invention relates to fluid sprinkling and more particularly to the fluid sprinkling of an aerosol product from an aerosol container having an improved vent.

2. Information Disclosure Statement

In a standard aerosol dispenser, an aerosol product and a propellant is sealed within an aerosol container by a mounting cup. The mounting cup houses an aerosol valve for regulating the discharge of the aerosol product from the aerosol container. Typically, a valve button is secured to the aerosol valve by a valve stem. The valve stem may either extend from the aerosol valve or may be integrally formed with the aerosol button. When the valve button is depressed, the aerosol valve is opened and product and propellant passes from the aerosol container through the valve stem to an internal channel within the valve button and is discharged from a terminal orifice within the valve button.

Although various types of valve buttons are available in the industry, the valve buttons may be classified as discrete valve buttons and overcap valve buttons. In a discrete valve button, the valve button is mounted to a valve stem extending between the aerosol valve and the valve button. In an overcap valve button, the valve button is incorporated into an overcap and the overcap is secured to the aerosol container. The valve button is pivotally mounted to the overcap for providing movement between a first and a second position.

The valve button is secured to the valve stem in a fluid tight engagement. Upon the depression of the valve button, aerosol product flows into an internal channel within the valve button and is discharged from the terminal orifice. Others in the prior art have used an apertured overcap having an open aperture within the overcap for spraying an aerosol product thereto. With an open apertured overcap, a separate valve button is mounted to the valve stem for providing a terminal orifice for the aerosol product and propellant. In the apertured overcap, the overcap does not function as a terminal orifice but merely provides the open aperture and an actuating mechanism for the valve button secured to the valve stem.

Aerosol devices have gained enormous popularity in the consumer market due to the convenience as well as the quality of spray of the aerosol devices. In general, aerosol devices provide a superior spray from a terminal orifice in comparison to other dispensing devices such as pumps or the like. Aerosol devices provide a uniform spray including the initial and the final portions of the spray period. Aerosol devices produce a desired burst of product and propellant during the opening of the aerosol valve and during the closing of the aerosol valve in contrast to other dispensing devices such as pumps and the like. These qualities have made the aerosol devices the preferred dispensing device for the consumer industry.

In some instances, aerosol devices do not provide a uniform spray at the initial and the final portions of the spray period. For example, if the diameter of the terminal orifice of the valve button is substantially smaller than the diameter of a channel of the valve stem, than a pressure is established within the internal channel of the valve button during the flow of the product and the propellant therethrough. Upon the closing of the aerosol valve, product is trapped under pressure in the internal channel of the valve button between the aerosol valve and the terminal orifice. The pressure within the internal channel of the valve button causes an undesired flow of the product from the terminal orifice at the final portion of the spray period. This undesired flow of the product from the terminal orifice is commonly referred to as "spitting" or "dribbling."

The undesired flow of the product from the terminal orifice at the final portion of the spray period is also encountered when a compressed gas is used as a propellant. In general, liquified propellants are more volatile than compressed gas propellants. Accordingly, a liquified propellant dissipates the pressure developed within the internal channel of the valve button faster than a compressed gas propellant. Compressed gas propellants are less volatile than liquified propellants and produce greater back pressure within the internal channel of the valve button. The greater back pressure produced by a compressed gas propellant causes the undesired flow of the product, "spitting" or "dribbling" from the terminal orifice at the final portion of the spray period.

In some instances, the product that is trapped under pressure in the internal channel of the valve button not only causes the undesired flow of the product from the terminal orifice at the final portion of the spray period but also causes an undesired flow of the product from the terminal orifice at the initial period of spraying of the next actuation of the aerosol valve. This undesired flow of the product from the terminal orifice at the initial period of spraying is commonly referred to as "pre-spitting" or "pre-dribbling."

Therefore it is a primary object of this invention to provide an improved aerosol spraying device which overcomes the difficulties at the final portion of the spray period commonly referred to as "spitting" or "dribbling."

Another object of this invention is to provide an improved aerosol spraying device incorporating vent means for directing product release from the aerosol valve after the closing of the aerosol valve to the vent means to prevent dribbling of the product from the terminal orifice.

Another object of this invention is to provide an improved aerosol spraying device incorporating vent means for directing product release from the aerosol valve after the closing of the aerosol valve to the vent means to prevent the undesired "spitting" or "dribbling" of the product from the terminal orifice.

Another object of this invention is to provide an improved aerosol spraying device incorporating vent means for directing product release from the aerosol valve after the closing of the aerosol valve to the vent means to prevent the undesired "prespitting" or "pre-dribbling" of the product from the terminal orifice.

Another object of this invention is to provide an improved aerosol spraying device which is compatible with existing aerosol valves and aerosol containers.

Another object of this invention is to provide an improved aerosol spraying device which provides a significant increase in performance of the spray while requiring only a minor modification to existing valve button and existing valve stem designs.

Another object of this invention is to provide an improved aerosol spraying device incorporating vent means which provides an improved product for the consumer.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full under standing of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention an relates to an improved method and apparatus for an aerosol spraying device for spraying a product released from an aerosol container. The device comprises an aerosol valve secured to the aerosol container and being moveable between an open and a closed position for releasing the product from the aerosol container when the aerosol valve is in the open position and for inhibition the release of the product from the aerosol container when the aerosol valve is in the closed position. The aerosol valve is resiliently biased into the closed position. A valve button having a terminal orifice for discharging the product release by the aerosol valve is movable between a first and a second position and is resiliently biased into the first position. The valve button moves the aerosol valve into the open position when the valve button is moved into the second position and enables the aerosol valve to move into the closed position when the valve button is in the first position. Vent means cooperating with the valve button and the aerosol valve is closed upon movement of the valve button from the first position to the second position for directing the product released from the aerosol valve to be discharged from the terminal orifice. The vent means is opened upon movement of the valve button from the second position to the first position for directing the product released from the aerosol valve during the closing of the aerosol valve to be directed to the vent means. The vent means redirects the product released from the aerosol valve during the closing of the aerosol valve from the valve button to be discharged from the vent means to prevent dribbling of the product from the terminal orifice.

In a more specific embodiment of the invention, the valve button includes a mounting base for securing to the aerosol container and with a resilient means interposed between the valve button and the mounting base for resiliently biasing the valve button into the first position. Preferably, the vent means includes the valve button being movable relative to the aerosol valve and the opening and closing of the vent means being in accordance with the relative movement between the valve button and the aerosol valve between a sealing position and a spaced position.

In another embodiment of the invention, the invention comprises an improved aerosol spraying device for spraying a product released from a valve stem extending from an aerosol valve of an aerosol container. A valve button has a stem aperture for receiving the valve stem therein and a terminal orifice with an internal channel extending between the stem aperture and the terminal orifice. Mounting means mounts the valve button relative to the aerosol valve of the aerosol container for movement between a first and a second position. The valve button moves the aerosol valve into an open position to release product from the valve stem upon movement of the valve button from the first position into the second position and enables the aerosol valve to move into a closed position to inhibit the release of the product from the valve stem upon movement of the valve button from the second position to the first position. Vent means cooperates with the valve button and the valve stem to close the vent means upon movement of the valve button from the first position to the second position for enabling the product released from the valve stem to enter the internal channel of the valve button and to be discharged from the terminal orifice. The vent means is opened upon movement of the valve button from the second position to the first position for enabling the product released from the valve stem during the closing of the aerosol valve to be discharged from the vent means.

In a more specific example of this embodiment, the aerosol container includes a mounting cup secured to the aerosol container and the mounting means includes resilient means interposed between the valve button and the mounting cup for resiliently biasing the valve button into the first position. More specifically, the mounting means includes a mounting base for securing to the aerosol container with the resilient means being interposed between the valve button and the mounting base for resiliently biasing the valve button into the first position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilize as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
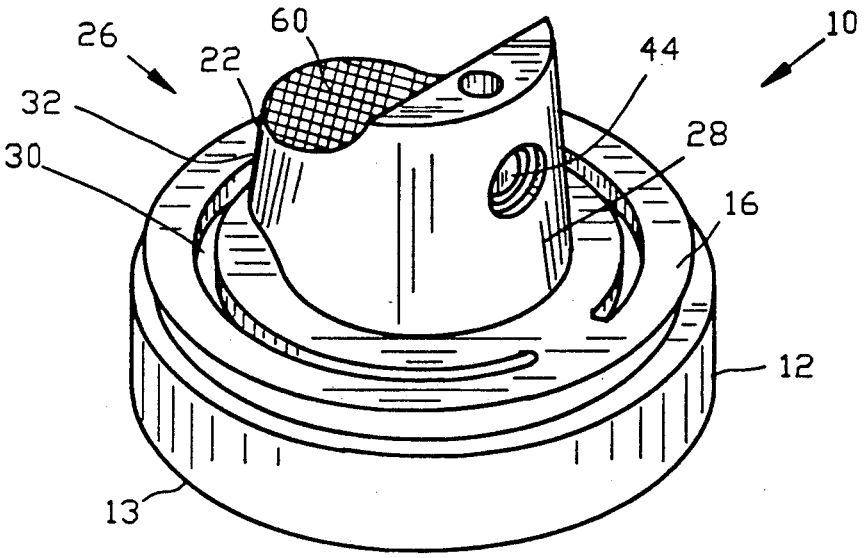
FIG. 1 is an isometric view of an aerosol overcap incorporating the present invention.
Figure 2:
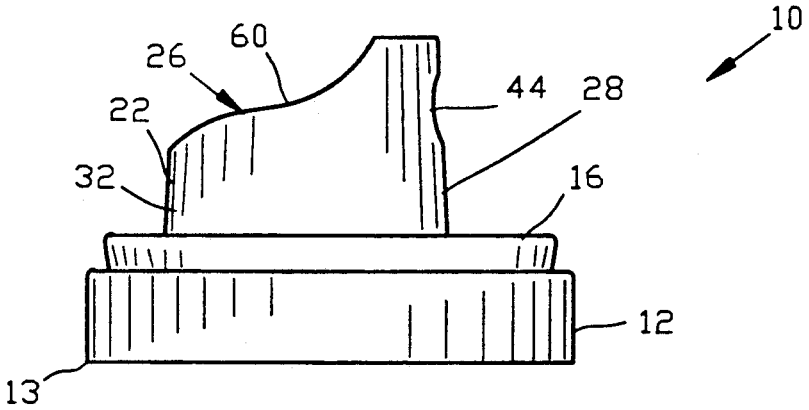
FIG. 2 is a side elevational view of the aerosol overcap of FIG. 1.
Figure 3:
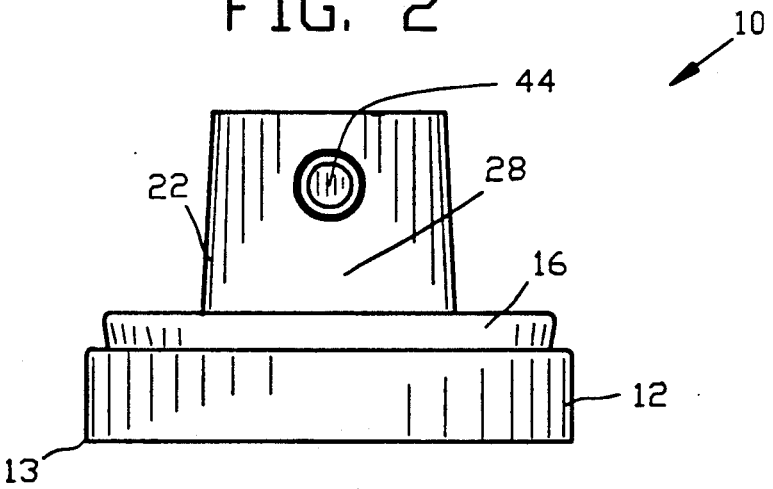
FIG. 3 is a front view of FIG. 1.
Figure 4:
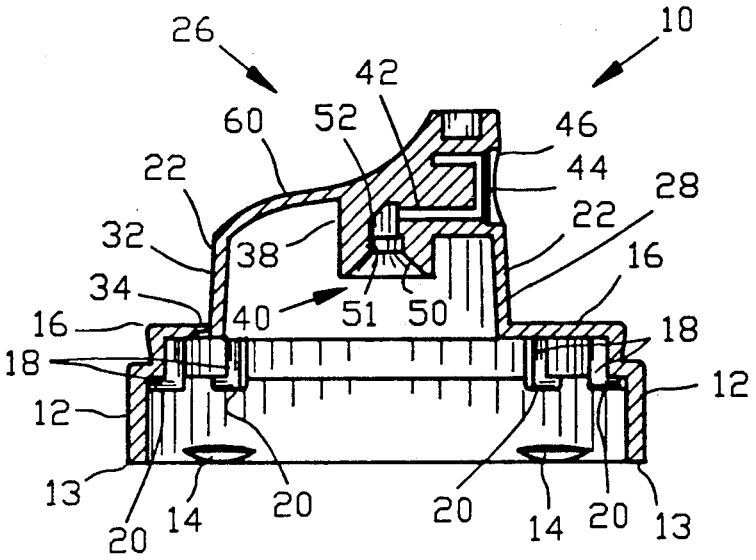
FIG. 4 is a side sectional view of the aerosol overcap of FIGS. 1-3.
Figure 5:
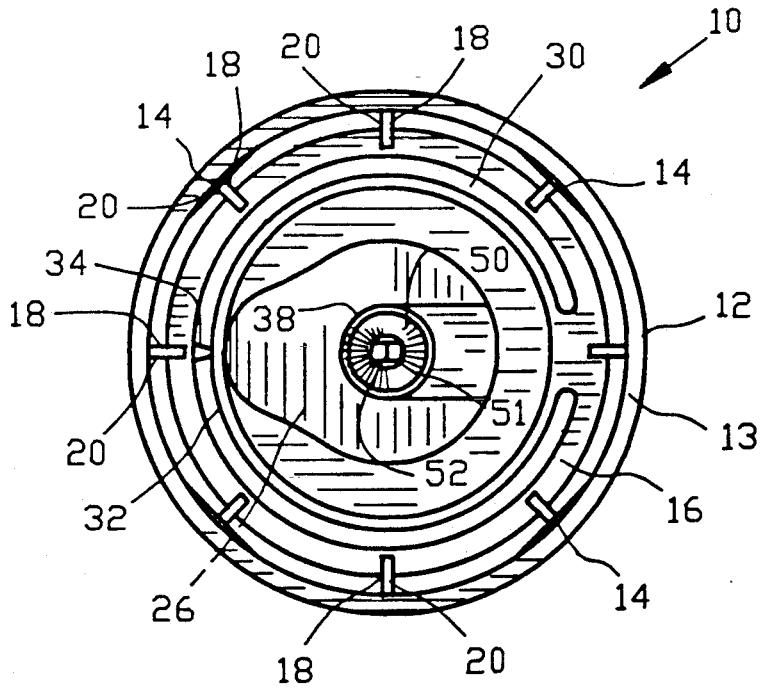
FIG. 5 is a bottom view of FIG. 4.
Figure 6:
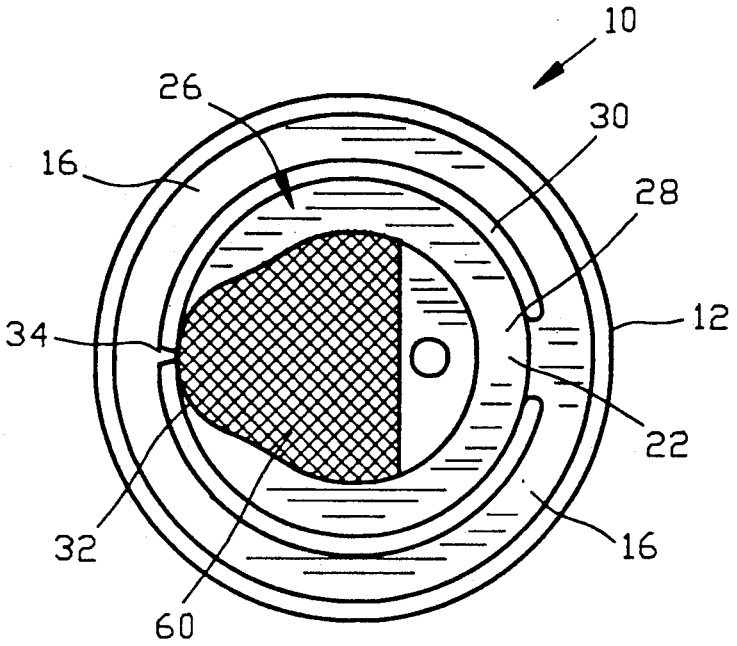
FIG. 6 is a plan view of FIG. 4.

FIG. 1 is an isometric view of an aerosol overcap 10 incorporating the present invention with FIGS. 2 and 3 illustrating a side elevational view and a front view thereof. FIG. 4 is a side sectional view of the aerosol overcap of FIGS. 1-3 with FIGS. 5 and 6 showing bottom and top views thereof. The overcap 10 comprises an annular base 12 having a base surface 13 and a plurality of projections 14 for securing the overcap 10 to an aerosol container as will be described in greater detail hereinafter. The base 12 supports a horizontal wall 16 with a plurality of radially spaced ribs 18 secured at the intersection of the base 12 and the horizontal wall 16. Each of the ribs 18 define a bottom surface 20 the function of which will be described thereafter hereinafter.

An annular flexible sidewall 22 supports a valve button shown generally 26. A front portion 28 of the annular flexible sidewall 22 is secured to the horizontal wall 16 with the annular flexible sidewall 22 and the horizontal wall 16 defining a groove 30 therebetween. A rear portion 32 of the annular flexible sidewall 22 is connected to the horizontal wall 16 by a frangible coupling 34. The frangible coupling 34 inhibits the movement of the valve button 26 relative to the base 12 prior to initial use by a consumer.

The valve button 26 includes a boss 38 which defines a stem aperture shown generally as 40. The stem aperture 40 is connected by an internal channel 42 to a terminal orifice 44 defined in a terminal orifice insert 46. It should be appreciated by those skilled in the art that the terminal orifice 44 may be integrally formed with the valve button 26 or may be defined within a terminal orifice insert 46 as shown. It should be apparent to those skilled in the art that the terminal orifice insert 46 enables terminal orifices of different sizes to be used with the same valve button 26.

The stem aperture 40 comprises an outer conical portion 50, an intermediate cylindrical portion 51 and an inner portion 53. The outer conical portion 50 is formed in the shape of a hollow truncated cone with the intermediate cylindrical portion 51 intersecting at a line of truncation of the outer conical portion 50. The intermediate cylindrical portion 51 is connected through the inner portion 52 to the internal channel 42. Preferably, the outer conical portion 51 is established at an angle of approximately 45 degrees relative to the base surface 13. Although the stem aperture 40 has been shown is a specific arrangement, it should be understood that numerous changes in the arrangement of the stem aperture 40 may be made within the contemplation of the present invention.

The resiliency of the annular flexible sidewall 22 enables the valve button 22 to pivot relative to the base 12 upon the application of external force by an operator on a finger receiving portion 60. Excessive pressure on the finger receiving portion 60 will sever the frangible coupling 34 and permit the valve button 26 to pivot upon the resiliency of the annular flexible sidewall 22.

Figure 7:
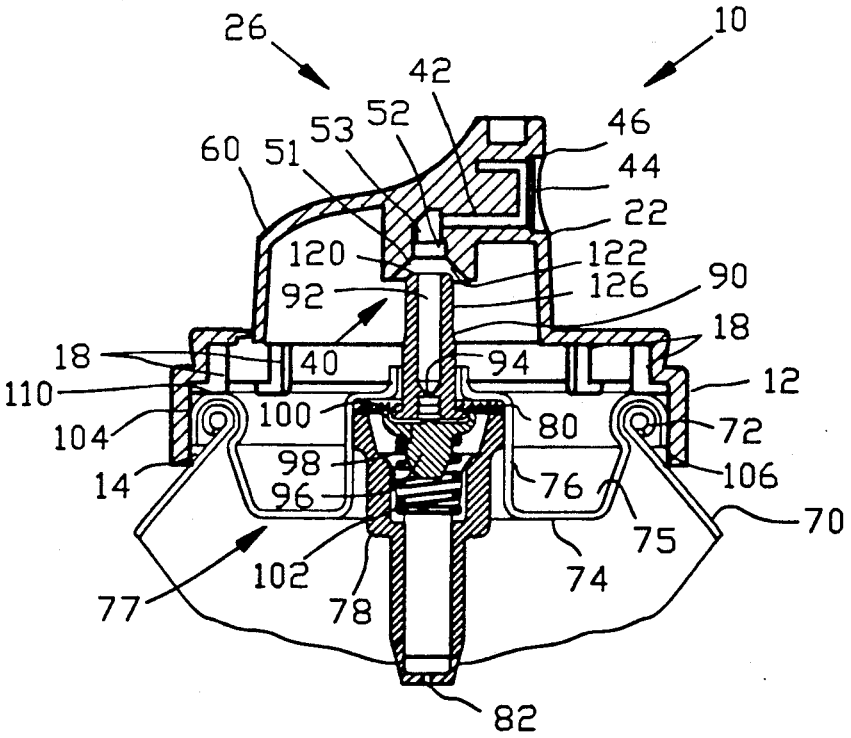
FIG. 7 is a side sectional view of the aerosol overcap of FIGS. 1-6 secured to an aerosol container having an aerosol valve with the aerosol overcap being shown in a first position and with the aerosol valve and valve stem being shown in a closed position.

FIGS. 7 illustrates the improved overcap 10 in association with an aerosol container 70. The aerosol container 70 has a peripheral rim 72 for receiving a valve mounting cup 74 with the valve mounting cup 74 being crimped to the aerosol container 70 in a conventional manner. The mounting cup 74 includes a well 75 supporting a turret 76 for receiving an aerosol valve shown generally as 77. The aerosol valve 77 includes a valve body 78 secured within the turret 76 with a sealing gasket 80 being interposed between the valve body 78 and the turret 76. A dip tube (not shown) extends from a valve bottom aperture 82 in the valve body 78 for communicating with the product within the aerosol container 70.

Figure 9:
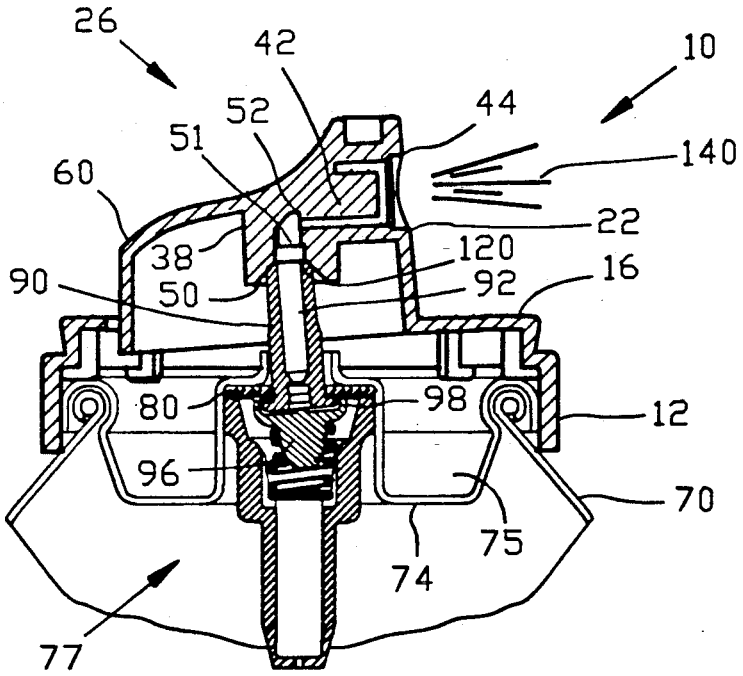
FIG. 9 is a side sectional view similar to FIG. 8 with the aperture of the aerosol overcap being shown engaging with the valve stem of the aerosol valve and with the aerosol overcap being shown in a second position and with the aerosol valve and valve stem being shown in an open position.

The aerosol valve 77 includes a valve stem 90 having a stem channel 92 and a metering aperture 94. A valve member 96 defines a platform 98 and an annular sealing ring 100 which is sealed against the sealing gasket 80 upon the urging of a spring 102. In this embodiment, the aerosol valve 77 is shown as a tilt valve which is movable between a closed position as shown in FIG. 7 and an open position as shown in FIG. 9. The spring 102 normally biases the aerosol valve 77 into the closed position as shown in FIG. 7. Upon lateral displacement of the valve stem 90 as shown in FIG. 9, the aerosol valve 77 is moved into the open position as shown in FIG. 9. The operation of the tilt valve should be well known to those skilled in the aerosol art. It also should be appreciated that the present invention is equally suitable for use with a conventional vertical action aerosol valve.

The overcap 10 is secured to the outer periphery 104 of the valve mounting cup 10 with the projections 14 engaging the terminal end 106 of the valve mounting cup 74. The bottom surfaces 20 of the ribs 18 of the overcap 10 engage an upper surface 110 of the mounting cup 77 thus providing a rigid coupling between the overcap 10 and the aerosol container 70. When the overcap 10 is rigidly coupled to the aerosol container 70, a terminal end 120 of the valve stem 90 is spaced from the outer conical portion 50 creating a vent 122.

Figure 12:
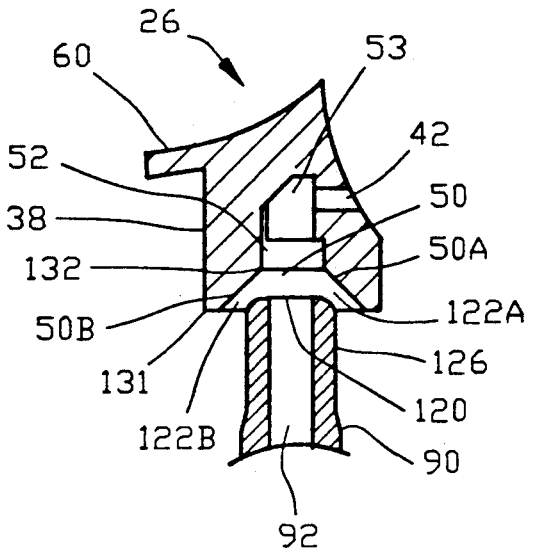
FIG. 12 is an enlarged sectional view of a portion of FIG. 7.

FIG. 12 is an enlarged sectional view of a portion of FIG. 7 illustrating the terminal end 122 of the valve stem 90 being spaced from a side 50A of the outer conical portion 50 creating a vent 122A therebetween. The terminal end 120 of the valve stem 90 is also spaced from a side 50B of the outer conical portion 50 creating a vent 122B therebetween.

FIG. 12 also illustrates the relative diameters of the outer conical portion 50, the intermediate cylindrical portion 51, the inner portion 53 and the valve stem 90. The diameters of the intermediate cylindrical portion 51 and the inner portion 52 are established to be substantially the same as the inner diameter of the stem channel 92.

The outer conical portion 50 defines an the outer diameter 131 and an inner diameter 132 whereas the external surface of the valve stem 90 defines an external diameter 126. In contrast to the prior art valve buttons, the outer diameter 131 of the outer conical portion 50 is established to be substantially larger than the external diameter 126 of the valve stem 90. In addition, the inner diameter 132 of the outer conical portion 50 is established to be substantially smaller than the external diameter 126 of the valve stem 90. Accordingly, the valve stem 90 is incapable of being secured to or permanently affixed to the stem aperture 40 of the valve button 26. The relative diameters of the outer conical portion 50, the intermediate cylindrical portion 51, the inner portion 53 and the valve stem 90 is in contrast to the prior art aerosol buttons and overcaps wherein the prior art valve button includes a stem aperture for retaining and sealingly engaging a valve stem extending from an aerosol valve.

FIG. 7-11 illustrate the sequence of operation of the improved overcap 10. In FIG. 7, the overcap is shown secured to the aerosol container 70 with a non-fractured frangible coupling 34 illustrating the condition in which the aerosol container and overcap containing the product is delivered to a consumer. The aerosol vale 77 is maintained in the closed position by the urging of the spring 102.

Figure 8:
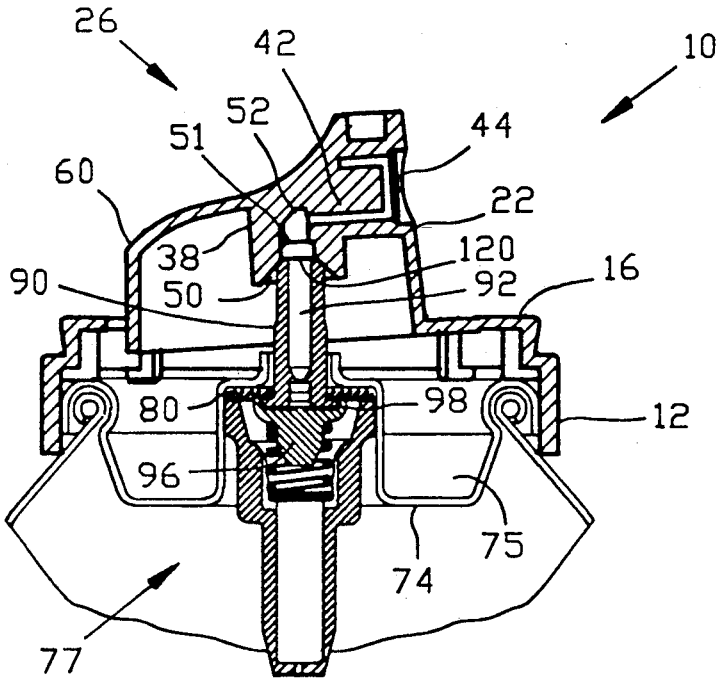
FIG. 8 is a side sectional view similar to FIG. 7 with an aperture of the aerosol overcap being shown engaging with the valve stem of the aerosol valve and with the aerosol valve and valve stem being shown in the closed position.

FIG. 8 illustrates the depression of the valve button 26 thus fracturing the frangible coupling 34 and pivoting the valve button 26 about the resilient annular flexible sidewall 22. The valve button 26 has been partially depressed from a first position shown in FIG. 7 to a position where the terminal end 122 of the valve stem 90 first makes contact with the outer conical portion 51. Since the valve button 26 has been only partially depressed from a first position to a position where the terminal end 122 of the valve stem 90 first makes contact with the outer conical portion 51, the aerosol vale 77 is still maintained in the closed position by the urging of the spring 102.

Figure 13:
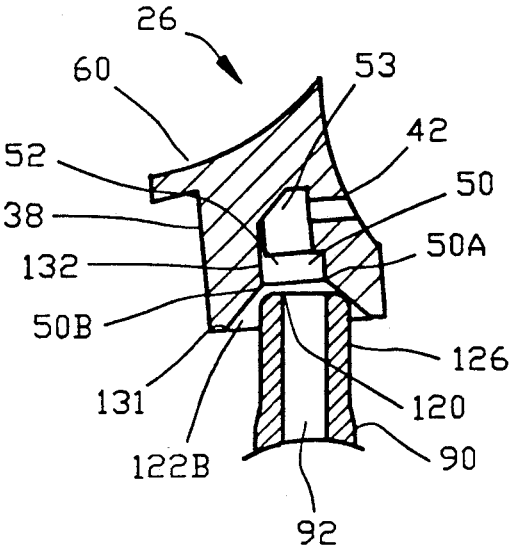
FIG. 13 is an enlarged sectional view of a portion of FIG. 8.

FIG. 13 is an enlarged sectional view of a portion of FIG. 8 illustrating the terminal end 122 of the valve stem 90 making contact with side 50A of the outer conical portion 50 while a vent 122B is maintained adjacent the side 50B of the outer conical portion 50.

Figure 14:
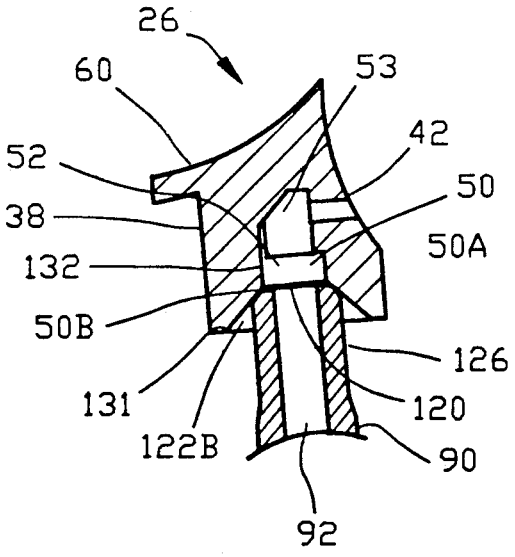
FIG. 14 is an enlarged sectional view of a portion of FIG. 9.

FIG. 9 illustrates the depression of the valve button 26 by an external force into a second position. As shown in greater detail in FIG. 14, the terminal end 122 of the valve stem 90 forms a seal with the outer conical portion 50 as illustrated by sides 50A and 50B. Concomitantly therewith, the sealing ring 100 of the valve member 96 is displaced from the sealing gasket 80 against the urging of spring 102. Accordingly, the product and propellant is allowed to flow from the aerosol container 70 through the interior of the valve body 78 and the stem channel 92 into the valve button 26. The product and propellant flows into the intermediate cylindrical portion 51 and through the inner portion 52 the internal channel 44 to be discharged from the terminal orifice 44 as a desired flow of the product 140. It should be appreciated that the dimensions of the valve stem 90 as well as the dimension of stem aperture 40 including the outer conical portion 50 is selected such that a proper seal is made between the terminal end 122 of valve stem 90 and the outer conical portion 50 simultaneously with the opening of the aerosol valve 77.

Since the diameter of the terminal orifice 44 of the valve button 26 is substantially smaller than the diameter of the stem channel 92 of the valve stem 90, a pressure is established within the intermediate cylindrical portion 51, the inner portion 53 and the internal channel 42 of the valve button 26 during the flow of the product and the propellant therethrough.

Figure 10:
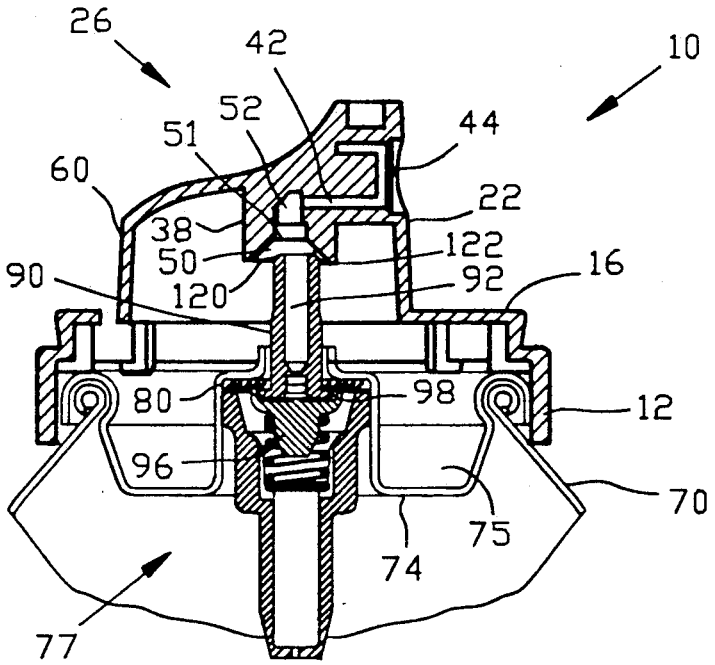
FIG. 10 is a side sectional view similar to FIG. 9 with the aperture of the aerosol overcap being shown spaced from the valve stem of the aerosol valve and with the aerosol valve and valve stem being shown in the open position.

FIG. 10 illustrates the release of the external force from the aerosol button 26 wherein the resiliency on the flexible annular sidewall 22 returns the valve button 26 from the second position as shown in FIG. 9 to the first position as shown in FIGS. 7 and 10. The aerosol vale 77 is simultaneously returned from the open position as shown in FIG. 9 to the closed position by the urging of the spring 102.

Figure 15:
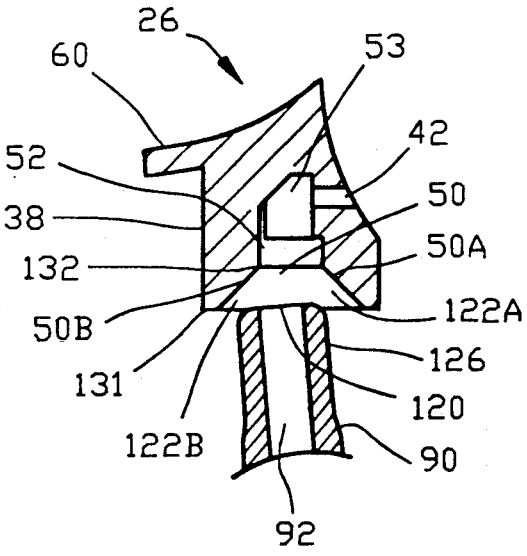
FIG. 15 is an enlarged sectional view of a portion of FIG. 10.

FIG. 15 is an enlarged sectional view of a portion of FIG. 10 illustrating the terminal end 122 of the valve stem 90 being spaced from a side 50A of the outer conical portion 50 creating a vent 122A therebetween. The terminal end 122 of the valve stem 90 is also spaced from a side 50B of the outer conical portion 50 creating a vent 122B therebetween. The vents 122A and 122B provide vent means for venting the pressure within the intermediate cylindrical portion 51, the inner portion 53 and the internal channel 42 of the valve button 26 during and after the closing of the aerosol valve 77. Since the diameter of the outer conical portion 50, the intermediate cylindrical portion 51, the inner portion 53 and the internal channel 42 of the valve button 26 are less than the diameter of the terminal orifice 44, any product under pressure within the intermediate cylindrical portion 51, the inner portion 53 and the internal channel 42 will be discharged from the outer conical portion 50 through vents 122A and 122B. Accordingly, the undesired flow of the product from the terminal orifice commonly referred to as "spitting" or "dribbling" is redirected from the terminal orifice 44 to be discharged from the vents 122A and 122B as indicated by the arrows.

Figure 11:
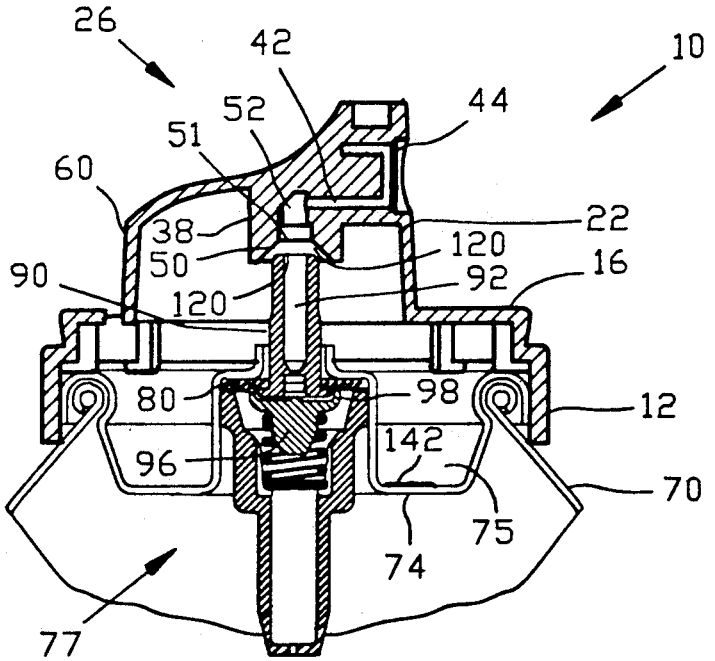
FIG. 11 is a side sectional view similar to FIG. 10 with the aperture of the aerosol overcap being shown returned into the first position and with the aerosol valve and valve stem shown returned into the closed position.

FIG. 11 illustrates the valve button 26 returned to the first position by the resiliency of the annular flexible sidewall 22 and the aerosol valve 77 being fully closed by the urging of the spring 102. The undesired flow of the product 142 that was discharged form the vents 122A and 122B accumulates within the well 75 of the valve mounting cup 74. Typically, the quantity of the undesired flow of the product 142 is relatively small and may accumulate within the well 75 of the valve mounting cup 74 without notice to the consumer.

The present invention provides an improved aerosol spraying device which overcomes the difficulties at the final portion of the spray period by directing product release from the aerosol valve during and after the closing of the aerosol valve to the vent means to prevent dribbling of the product from the terminal orifice. The invention also overcomes dribbling of product at the initial portion of the spray period by venting product release from the previous actuation of the aerosol valve.

The device is compatible with existing aerosol valves and aerosol containers and is especially well suited for use with small terminal orifices, typically between 0.004 inches and 0.030 inches, and or small vapor taps with compressed gas propellants. The present invention provides a significant increase in performance in aerosol spray technology while requiring only minor modifications to existing valve button and existing valve stem designs resulting in an improved product for the consumer.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved aerosol spraying device for spraying a product released from an aerosol valve of an aerosol container through a generally cylindrical valve stem having a terminal end extending from the aerosol container; the aerosol valve being biased into a closed position by valve bias means and being movable into an open position upon a lateral movement of the generally cylindrical valve stem, comprising:

a valve button comprising a stem aperture having an outer generally conical portion communicating through an internal channel to a terminal orifice defined in said valve button;

resilient mounting means for resiliently mounting said valve button relative to the aerosol valve for movement between a first and a second position and for resiliently biasing said valve button into said first position;

said resilient mounting means being spaced from said generally cylindrical valve stem enabling said valve button to laterally move the aerosol valve into the open position upon movement of said valve button from said first position into said second position to release product from the aerosol container;

said resilient mounting means enabling a partial depression of said valve button from said first position to a first parallel depression to move a first side of said outer generally conical portion of said stem aperture into engagement with the terminal end of the generally cylindrical valve stem and with a second side of said outer generally conical portion of said stem aperture being spaced from the terminal end of the generally cylindrical valve stem for creating vent means therebetween;

said resilient mounting means enabling a continued depression of said valve button from said first partial depression to a second partial depression to move said second side of said outer generally conical portion of said stem aperture into engagement with the terminal end of the generally cylindrical valve stem for creating a seal therebetween;

said resilient mounting means enabling a further depression of said valve button from said second partial depression into said second position to move said outer generally conical portion of said stem aperture for laterally displacing the generally cylindrical valve stem to open the aerosol valve for releasing product from the aerosol container through said internal channel for discharge from said terminal orifice;

said resilient mounting means enabling a release of said valve button to move said second side of said outer generally conical portion of said stem aperture out of engagement with and in a spaced relation to the terminal end of the generally cylindrical valve stem for creating said vent means therebetween and for enabling the valve bias means to return the aerosol valve into the closed position for inhibiting the further release of the product from the aerosol container into the generally cylindrical valve stem; and said vent mean redirecting the product released from the valve stem during the closing of the aerosol valve from entering said internal channel of said valve button to be discharged from said vent means.

* * * * *